US008790091B2

(12) United States Patent
Mehta et al.

(10) Patent No.: US 8,790,091 B2
(45) Date of Patent: Jul. 29, 2014

(54) PUMP HAVING PORT PLATE PRESSURE CONTROL

(75) Inventors: Viral S. Mehta, Peoria, IL (US); Noah D. Manring, Columbia, MO (US); Hongliu Du, Naperville, IL (US); Bryan E. Nelson, Lacon, IL (US)

(73) Assignees: Caterpillar Inc., Peoria, IL (US); The Curators of the University of Missouri, Kansas City, MO (US)

( * ) Notice: Subject to any disclaimer, the term of this patent is extended or adjusted under 35 U.S.C. 154(b) by 357 days.

(21) Appl. No.: 13/116,709

(22) Filed: May 26, 2011

(65) Prior Publication Data

US 2012/0301326 A1 Nov. 29, 2012

(51) Int. Cl.
*F04B 1/32* (2006.01)

(52) U.S. Cl.
USPC ..... 417/222.1; 91/483

(58) Field of Classification Search
CPC ..... F04B 1/2042; F04B 1/303
USPC ..... 91/483, 482, 505; 417/53, 218, 222.1, 417/466, 462; 92/12.2
See application file for complete search history.

(56) References Cited

U.S. PATENT DOCUMENTS 2,642,809 A * 6/1953 Born et al. ..... 91/6.5
3,190,232 A * 6/1965 Budzich ..... 417/222.1
3,221,660 A * 12/1965 D Amato ..... 417/222.1
4,872,394 A 10/1989 Nakagawa et al.
5,564,905 A 10/1996 Manring
6,468,046 B1 * 10/2002 Du et al. ..... 417/222.1
2010/0150741 A1 6/2010 Mehta et al.

FOREIGN PATENT DOCUMENTS

JP 03-078573 A 3/1991
JP 04-284181 A 8/1992
JP 2006037900 2/2006

OTHER PUBLICATIONS

International Search Report and Written Opinion issued Dec. 26, 2012, for PCT International Application No. PCT/US2012/039322.

* cited by examiner

*Primary Examiner* — Bryan Lettman
(74) *Attorney, Agent, or Firm* — Finnegan, Henderson, Farabow, Garrett & Dunner LLP

(57) ABSTRACT

A pump is disclosed. The pump may have a housing, a body rotatably disposed within the housing and at least partially defining a plurality of barrels, a plurality of plungers associated with the plurality of barrels, and a swashplate tiltable by a swivel torque to vary a displacement of the plurality of plungers relative to the plurality of barrels. The pump may also have a port plate with an inlet port, a discharge port, and a protrusion. The port plate may be configured to engage an end of the rotatable body. The pump may further have at least one piston disposed within the housing and configured to selectively engage the protrusion of the port plate to rotate the port plate and adjust the swivel torque.

18 Claims, 4 Drawing Sheets

PUMP HAVING PORT PLATE PRESSURE CONTROL

TECHNICAL FIELD

The present disclosure relates generally to a pump, and more particularly, to a pump having port plate pressure control.

BACKGROUND

Hydraulic tool systems typically employ multiple actuators provided with high-pressure fluid from a common pump. In order to efficiently accommodate the different flow and/or pressure requirements of the individual actuators, these systems generally include a pump having variable displacement. Based on individual and/or combined flow and pressure requirements of the actuators, the pump changes a fluid displacement amount to meet demands.

Typical variable displacement pumps used in hydraulic tool systems are known as swashplate-type pumps. A swashplate-type pump includes a plurality of plungers held against a plunger engagement surface of a tiltable swashplate. A ball-and-socket slipper joint is disposed between each plunger and the engagement surface to allow for relative sliding/pivoting movement between the swashplate and the plungers. Each plunger reciprocates within an associated barrel as the plungers rotate relative to the tilted engagement surface of the swashplate. When a plunger is retracted from an associated barrel, low-pressure fluid is drawn into that barrel. When the plunger is forced back into the barrel by the plunger engagement surface of the swashplate, the plunger pushes fluid from the barrel at an elevated pressure.

The tilt angle of the swashplate is directly related to an amount of fluid pushed from each barrel during a single relative rotation between the plungers and the swashplate. Similarly, based on a restriction of a fluid circuit connected to the pump, the amount of fluid pushed from the barrel during each rotation is directly related to the flow rate and pressure of fluid exiting the pump. Accordingly, a higher swashplate tilt angle of a pump equates to a greater flow rate and/or pressure of the pump, while a lower swashplate tilt angle results in a lower flow rate and/or pressure. Likewise, a higher swashplate tilt angle requires more power from a driving source to produce the higher flow rates and pressures than does a lower swashplate tilt angle. As such, when the demand for fluid is low, the swashplate angle is typically reduced to lower the power consumption of the pump.

Historically, the tilt angle of the swashplate has been controlled by way of one or more actuators located on opposing sides of the swashplate. These actuators are selectively extended against a bottom surface of the swashplate or retracted away from the swashplate to directly tilt the swashplate about a tilt axis toward a desired angle against a spring bias. Although effective, these types of actuators can be expensive, difficult to control, and slow to respond.

A pump having an alternative type of displacement actuator used to vary the tilt angle of a swashplate is disclosed in U.S. Pat. No. 5,564,905 issued to Manring on Oct. 15, 1996 (the '905 patent). In particular, the '905 patent discloses a hydraulic unit including a flat port plate disposed between a stationary head and a rotatable cylinder barrel. An arcuate actuator piston extends from the port plate and is slidably disposed within an arcuate pocket in the head to define an actuator chamber. Similarly, an arcuate biasing piston having a pressure area smaller than the actuator piston extends from the port plate and is slidably disposed within another arcuate pocket in the head to define a biasing chamber. The biasing chamber is continuously communicated with a discharge passage in the head, while the actuator chamber is selectively communicated with a control pressure. When the control pressure exceeds a threshold pressure within the actuator chamber, the port plate is caused to rotate in a counterclockwise direction by the actuator piston. When the control pressure falls below the threshold pressure, the port plate is caused to rotate in a clockwise direction by the biasing piston. By selectively rotating the port plate, an amount of fluid pressure carryover of the pump can be varied, thereby changing a swivel torque acting on a swashplate of the pump. In this manner, the swivel toque can be controlled to vary the tilt angle of the swashplate.

While the pump of the '905 patent may provide for tilt angle control of a pump without the use of conventional swashplate-engaging actuators, it may still be less than optimal. In particular, the arcuate pistons, pockets, and chambers disclosed in the '905 patent may be difficult and expensive to fabricate.

The disclosed pump is directed to overcoming one or more of the problems set forth above and/or other problems of the prior art.

SUMMARY

In one aspect, the present disclosure is directed to a pump. The pump may include a housing, a body rotatably disposed within the housing and at least partially defining a plurality of barrels, a plurality of plungers associated with the plurality of barrels, and a swashplate tiltable by a swivel torque to vary a displacement of the plurality of plungers relative to the plurality of barrels. The pump may also include a port plate with an inlet port, a discharge port, and a protrusion. The port plate may be configured to engage an end of the rotatable body. The pump may further include at least one piston disposed within the housing and configured to selectively engage the protrusion of the port plate to rotate the port plate and adjust the swivel torque.

In another aspect, the present disclosure is directed to method of controlling a pump. The method may include rotating a plurality of plungers past an inlet port in a plate during retracting strokes to draw fluid into a plurality of bores, and rotating the plurality of plungers past a discharge port in the plate during expanding strokes to discharge fluid from the plurality of bores at an elevated pressure. The method may further include selectively moving at least one piston to engage and rotate the plate. Rotation of the plate changes an effective displacement of the plurality of plungers within the plurality of bores.

DETAILED DESCRIPTION

Figure 1:
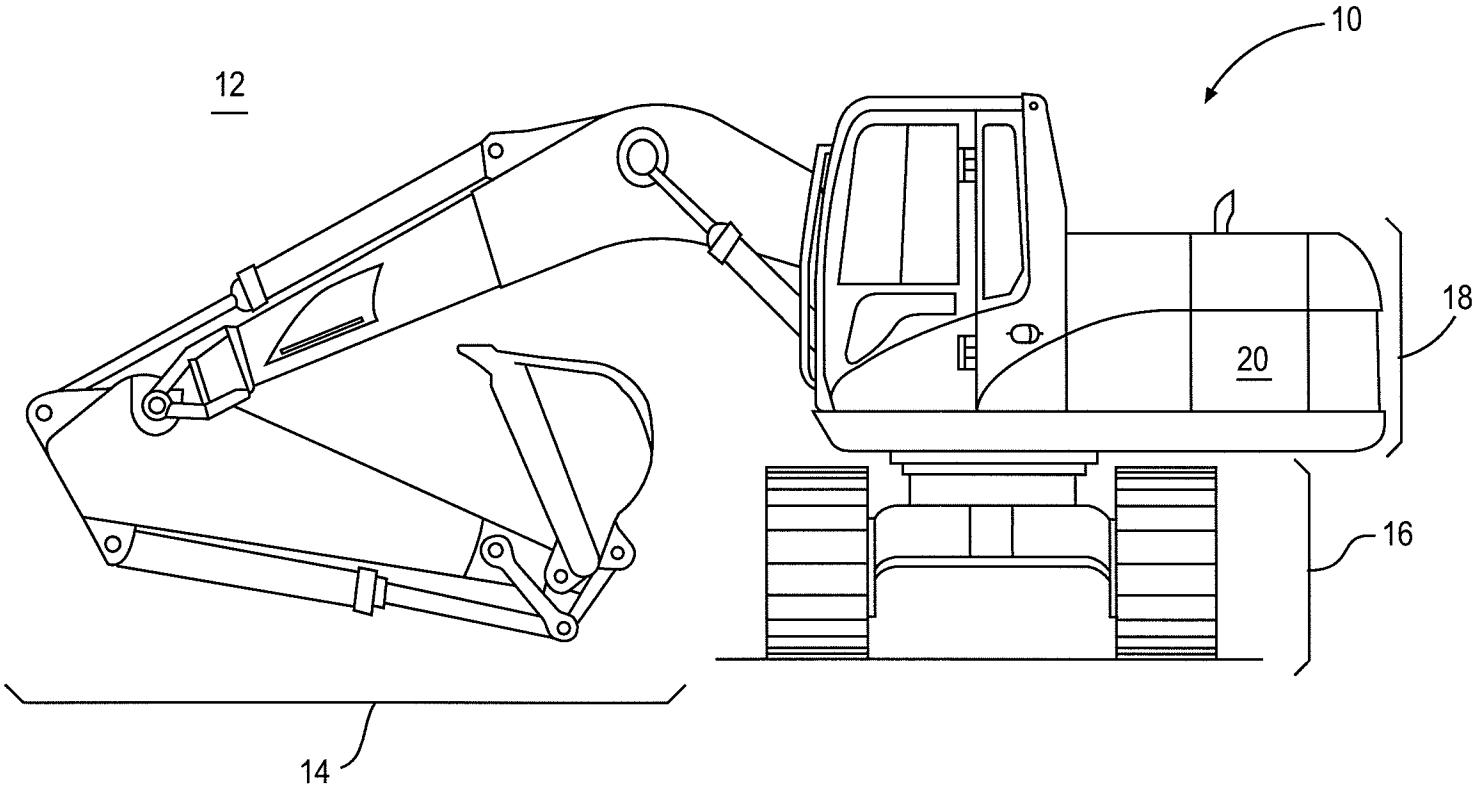
FIG. 1 is a pictorial illustration of an exemplary disclosed machine.

FIG. 1 illustrates an exemplary machine 10 performing a particular function at a worksite 12. Machine 10 may embody a stationary or mobile machine, with the particular function being associated with an industry such as mining, construction, farming, transportation, power generation, oil and gas, or another industry known in the art. For example, machine 10 may be an earth moving machine such as the excavator depicted in FIG. 1, in which the particular function includes the removal of earthen material from worksite 12 that alters the geography of worksite 12 to a desired form. Machine 10 may alternatively embody a different earth moving machine such as a motor grader or a wheel loader, or a non-earth moving machine such as a passenger vehicle, a stationary generator set, or a pumping mechanism.

Machine 10 may be equipped with multiple systems that facilitate operation thereof at worksite 12, for example a tool system 14, a drive system 16, and an engine system 18 that provides power to tool system 14 and drive system 16. During the performance of most tasks, power from engine system 18 may be split between tool system 14 and drive system 16. That is, during machine travel between excavation sites, a mechanical output of engine system 18 may be converted to a rotation of traction devices that propel machine 10, in some examples by way of a hydraulic or hydro-mechanical transmission (not shown). When parked at an excavation site and actively moving material, the mechanical output of engine system 18 may be converted to hydraulic power supplied to one or more working actuators of tool system 14.

Figure 2:
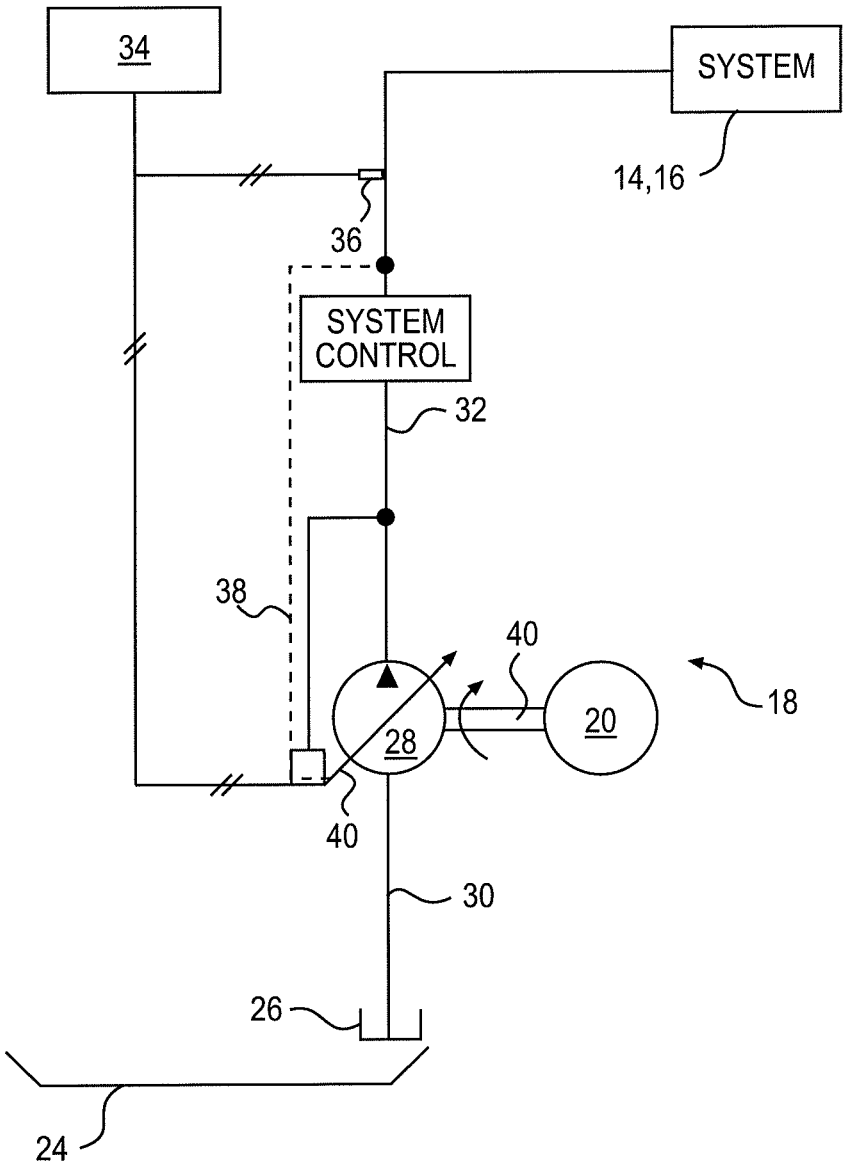
FIG. 2 is a schematic illustration of an exemplary disclosed pump system that may be utilized in conjunction with the machine of FIG. 1.

As illustrated in FIG. 2, engine system 18 may include a heat engine 20, for example an internal combustion engine, that is coupled with a pump system 24. Pump system 24 may include a collection of components that are driven by engine 20 to hydraulically power tool and/or drive systems 14,16. Specifically, pump system 24 may include a low-pressure tank 26, and a pump 28 fluidly connected to tank 26 by way of an inlet passage 30 and to systems 14, 16 by way of an outlet passage 32. Pump 28 may be driven by engine 20 to draw in low-pressure fluid from tank 26 and discharge the fluid at an elevated pressure to systems 14, 16.

Two alternative embodiments of pump system 24 are shown in FIG. 2, including a first embodiment where a displacement of pump 28 is electronically regulated by a controller 34 in response to a pressure signal generated by a sensor 36. In a second embodiment, the displacement of pump 24 may be hydro-mechanically regulated based on a pressure within a load-sense line 38, without the use of controller 34 and sensor 36.

Figure 3:
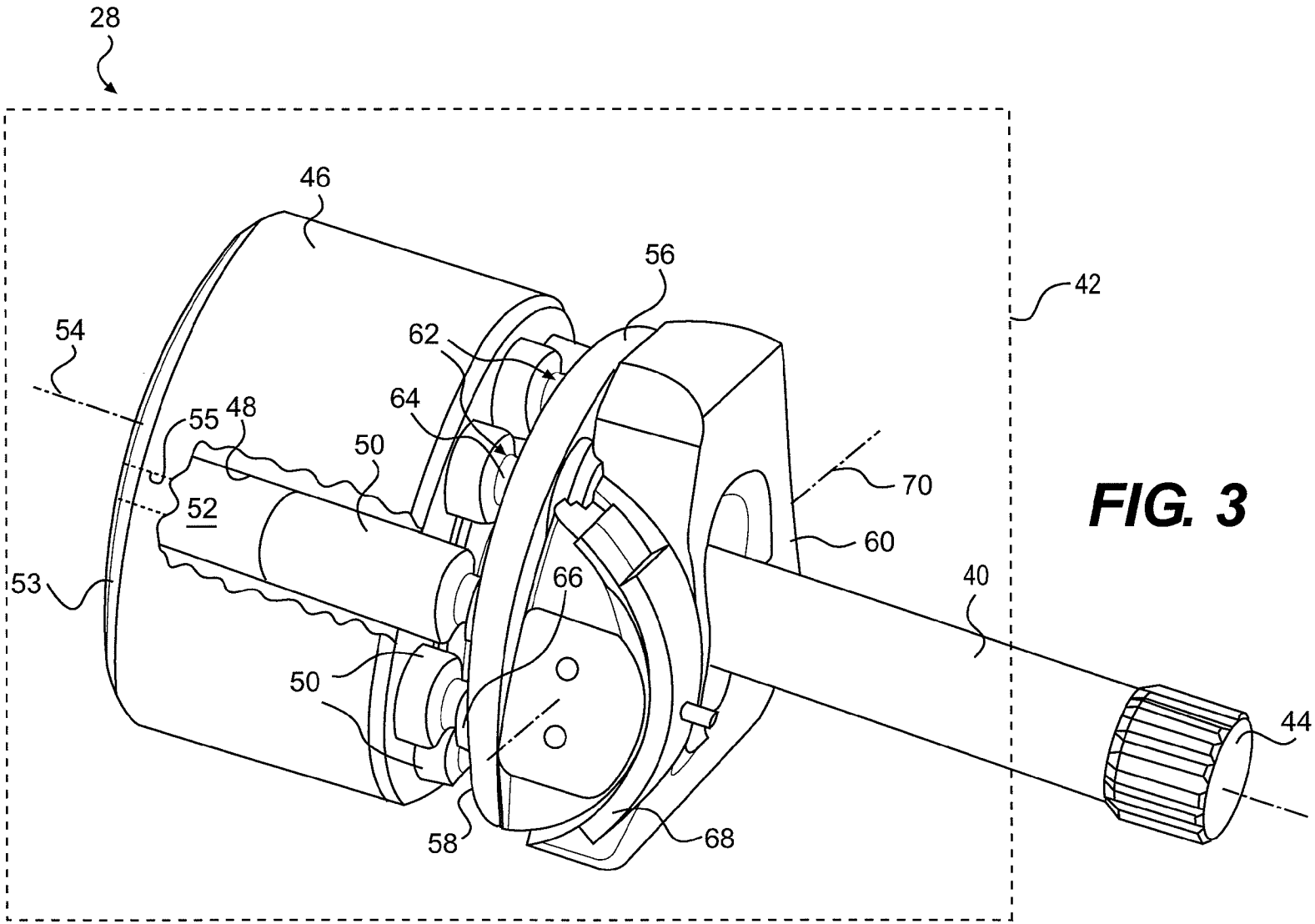
FIG. 3 is a cutaway view illustration of a pump that may form a portion of the pump system of FIG. 3.

Pump 28 may be driven by engine 20 via a driveshaft 40. As illustrated in FIG. 3, driveshaft 40 may extend from one end of a housing 42 and include a splined interface 44 for connection with engine 20, for example with a gear train (not shown) of engine 20. Housing 42 may enclose a body 46 that at least partially defines a plurality of barrels 48 (only one shown). Pump 28 may also include a plurality of plungers 50, one plunger 50 slidingly disposed within each barrel 48. Each barrel 48 and each associated plunger 50 may together at least partially form a pumping chamber 52 configured to receive and discharge fluid by way of a port plate 53. It is contemplated that any number of pumping chambers 52 may be included within body 46 and symmetrically and radially disposed about a central axis 54. Although central axis 54 is shown as being generally coaxial with driveshaft 40, it is contemplated that central axis 54 may alternatively be oriented at an angle relative to driveshaft 40, such as in a bent-axis type pump, if desired.

Body 46 may be connected to rotate with driveshaft 40. That is, as driveshaft 40 is rotated by engine 20 (referring to FIG. 2), body 46 and plungers 50 located within barrels 48 of body 46 may all rotate together about central axis 54. As body 46 rotates, individual passageways 55 associated with each pumping chamber 52 may pass by inlet and discharge ports of port plate 53 to draw in and expel pressurized fluid.

Pump 28 may be a swashplate-type of pump. Specifically, pump 28 may include a generally stationary swashplate 56 having a plunger engagement surface 58 and a tiltable base 60. Plunger engagement surface 58 may be located between plungers 50 and tiltable base 60 to operatively engage plungers 50 by way of a ball and socket joint 62. That is, each plunger 50 may have a generally spherical end 64, which may be biased into engagement with a cup-like socket located within a slipper foot 66. Slipper feet 66 may be configured to slide along plunger engagement surface 58, which may be connected to or otherwise integral with tiltable base 60.

Swashplate 56 may be selectively tilted to vary a stroke of plungers 50 within barrels 48 (i.e., a displacement of plungers 50). Specifically, tiltable base 60 may be situated within a bearing member 68 and pivotal about a tilt axis 70. In one embodiment, tilt axis 70 may pass through and be substantially perpendicular to central axis 54. As tiltable base 60 and connected plunger engagement surface 58 pivot about tilt axis 70, the plungers 50 located on one half of plunger engagement surface 58 (relative to tilt axis 70) may retract into their associated barrels 48, while the plungers 50 located on an opposing half of plunger engagement surface 58 may extend out of their associated barrels 48 by about the same amount. As plungers 50 rotate about central axis 54, plungers 50 may annularly move from the retracted side of plunger engagement surface 58 to the extended side, and repeat this cycle as driveshaft 40 continues to rotate.

As plungers 50 move out of barrels 48, fluid may be drawn into chambers 52. Conversely, as plungers 50 retract back into barrels 48, the fluid may be discharged from chambers 52 at an elevated pressure. An amount of movement between the retracted and extended positions may relate to an amount of fluid displaced by plungers 50 during a single rotation of driveshaft 40. Because of the connection between plungers 50 and plunger engagement surface 58, the tilt angle of plunger engagement surface 58 may relate to the displacement of plungers 50. One or more pressure relief valves (not shown) located within pump 28 or within outlet passage 32 (referring to FIG. 2) may affect the pressure of the fluid discharged from pumping chambers 52.

Figure 4:
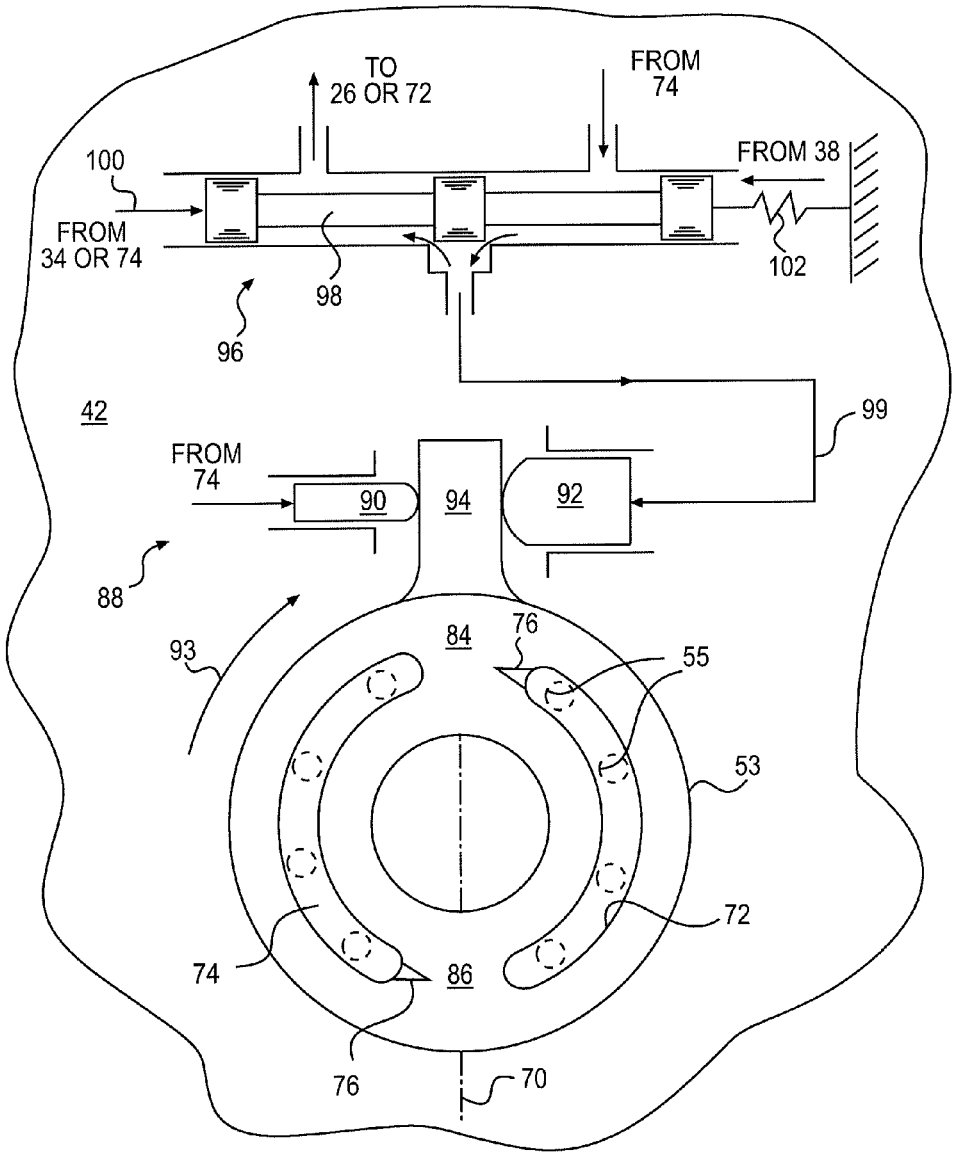
FIG. 4 is a schematic and diagrammatic illustration of a portion of the pump of FIG. 3.

As shown in FIG. 4, port plate 53 may include a generally arcuate inlet port 72 located within one half of port plate 53, relative to tilt axis 70, and a similar generally arcuate discharge port 74 located within an opposing half of port plate 53. A metering slot 76 may be provided at a leading end of each of inlet and discharge ports 72, 74. As body 46 and associated pumping chambers 52 rotate relative to port plate 53 (e.g., rotate clockwise in FIG. 4), passageways 55 may move into and out of fluid communication with inlet and discharge ports 72, 74. Metering slots 76 may help to reduce a shock loading associated with these periodic communications. Plungers 50 may reach a top-dead-center (TDC) position during a discharge stroke at a transition area 84 located between a trailing end of discharge port 74 and a leading end of inlet port 72, and reach a bottom-dead-center (BDC) position during an intake stroke at a transition area 86 located between a trailing end of inlet port 72 and a leading end of discharge port 74. Transition areas 84, 86 may generally be aligned with tilt axis 70.

An actuator 88 may be configured to selectively rotate port plate 53 relative to tilt axis 70, thereby changing a reactive force on plungers 50 that is generated by fluid trapped within chambers 52 as plungers 50 pass through transition areas 84, 86. That is, actuator 88 may be configured to selectively rotate port plate 53 such that transition areas 84, 86 no longer align with tilt axis 70. When transition areas 84, 86 are skewed to a side of tilt axis 70, pressurized fluid within chambers 52 may act on transition areas 84, 86 and generate a reactive force that passes through plungers 50 and results in a swivel torque on swashplate 56 that changes a tilt angle of swashplate 56. In this manner, an amount of rotation of port plate 53 in a particular direction can be controlled to generate a particular swivel torque and resulting tilt angle change of swashplate 56.

Actuator 88 may include a biasing piston 90 and an actuator piston 92. Biasing piston 90 may be disposed within housing 42 and arranged to push on one side of a protrusion, for example a tab 94, that protrudes radially outward from a periphery of port plate 53. Actuator piston 92 may also be disposed within housing 42 and arranged to push on a side of tab 94 opposite biasing piston 90. The force exerted by biasing piston 90 on tab 94 may urge port plate 53 to rotate in a direction generally aligned with the rotational direction of body 46 (e.g., shown as clockwise in FIG. 4 via an arrow 93), while the force exerted by actuator piston 92 on tab 94 may urge port plate 53 to rotate in a direction generally opposite the rotational direction of body 46. Biasing piston 90 may be located on the same side of tilt axis 70 as discharge port 74, and have a pressure area exposed to pressurized fluid from discharge port 74. Actuator piston 92 may be located on the same side of tilt axis 70 as inlet port 72, and have a pressure area larger than the pressure area of biasing piston 90. The pressure area of actuator piston 92 may be selectively exposed to either pressurized fluid from discharge port 74 or fluid from a low-pressure source (e.g., from tank 26 or inlet port 72). When actuator piston 92 is exposed to pressurized fluid from discharge port 74, the force generated by actuator piston 92 may be greater than the force generated by biasing piston 90 and port plate 53 may be caused to rotate in the direction opposite arrow 93. When actuator piston 92 is fluidly communicated with the low-pressure source, the force generated by actuator piston 92 may be less than the force generated by biasing piston 90 and port plate 53 may be caused to rotate in the direction aligned with arrow 93.

A pressure control valve 96 may be associated with actuator 88 and configured to regulate the control pressure of actuator piston 92, thereby controlling in which direction port plate 53 is rotated by actuator 88 and in which direction swashplate 56 is subsequently tilted. Pressure control valve 96 may include a 3-position valve element 98 that is movable between a first position at which high-pressure fluid from discharge port 74 is communicated with actuator piston 92 via a passage 99, and a second position at which actuator piston 92 is fluidly communicated with the low-pressure source (i.e., with tank 26 or inlet port 72) via passage 99. Pressure control valve 96 may be spring biased toward the first position.

At least two different embodiments of pressure control valve 96 may be possible. In a first exemplary embodiment, valve element 98 may be caused to move in the direction of an arrow 100 (i.e., against the bias of a spring 102) toward the second potion. That is, pressure control valve 96 may be a solenoid type of valve that, when energized by the command signal, generates an electromotive force that urges valve element 98 toward to its second position. In an alternative embodiment, valve element 98 may be caused to move in or against the direction of arrow 100 by fluid pressure acting on ends of thereof. Specifically, load-sense line 38 may fluidly communicate with an end of valve element 98 together with the bias of spring 102, while fluid pressure from discharge port 74 fluidly communicates with an opposing end of valve element 98. In this configuration, when a pressure within load-sense line 38 generates a force together with the bias of spring 102 that exceeds the opposing force generated by fluid from discharge port 74, valve element 98 may move in the direction opposite arrow 100, and vice versa.

INDUSTRIAL APPLICABILITY

The disclosed pump finds potential application in any fluid system where simplified tilt angle control, high-efficiency, and responsiveness are desired. The disclosed pump finds particular applicability in tool systems, especially tool system for use onboard mobile machines. One skilled in the art will recognize, however, that the disclosed pump could be utilized in relation to other fluid systems that may or may not be associated with hydraulically operated tools. For example, the disclosed hydraulic unit could be utilized in relation to an engine lubrication, cooling, fueling, and/or drive system.

Referring to FIG. 3, when driveshaft 40 is rotated, body 46 and plungers 50 disposed within barrels 48 of body 46 may also rotate. As plungers 50 rotate about central axis 54, spherical ends 64 and paired slippers 66 thereof, riding along tilted plunger engagement surface 58, may cause plungers 50 to cyclically rise and fall in the axial direction of driveshaft 40 (i.e., to extend into and retract from barrels 48). This reciprocating motion may function to draw fluid into pumping chambers 52 and push the fluid from pumping chambers 52 at an elevated pressure.

During operation of pump 28, the flow rate and/or pressure of the fluid exiting body 46 may be varied to changing meet demands of the associated system (e.g., tool and/or drive systems 14, 16). To decrease the flow rate and/or pressure of the fluid discharged by pump 28, the tilt angle of plunger engagement surface 58 may be decreased by selectively causing rotation of port plate 53 in the counterclockwise direction (i.e., the direction against arrow 93 of FIG. 4 and against the rotation of body 46). Port plate 53 may be caused to rotate in this manner by moving (or allowing movement of) valve element 98 of pressure control valve 96 leftward (with respect to FIG. 4) under the bias of spring 102, thereby reducing the force of actuator piston 92 on tab 94 below the relatively constant and opposing force of biasing piston 90. Conversely, to increase the flow rate and/or pressure of the discharged fluid, the tilt angle of plunger engagement surface 58 may be increased by selectively causing rotation of port plate 53 in the clockwise direction (i.e., in the direction of arrow 93 of FIG. 4 and with the rotation of body 46). Port plate 53 may be caused to rotate in this manner by moving valve element 98 of pressure control valve 96 rightward (with respect to FIG. 4) via an electromotive or pressure-induce force, thereby increasing the force of actuator piston 92 on tab 94 above the relatively constant and opposing force of biasing piston 90.

Because pump 28 may utilize simplified biasing and actuator pistons 90, 92 that are separate from port plate 53, the cost and manufacturing complexity of pump 28 may be reduced. In addition, the separation of biasing and actuator pistons 90, 92 from port plate 53 may provide flexibility in packaging.

It will be apparent to those skilled in the art that various modifications and variations can be made to the disclosed pump. Other embodiments will be apparent to those skilled in the art from consideration of the specification and practice of the disclosed pump. It is intended that the specification and examples be considered as exemplary only, with a true scope being indicated by the following claims and their equivalents.

What is claimed is:

1. A pump, comprising:

a housing;

a body rotatably disposed within the housing and at least partially defining a plurality of barrels;

a plurality of plungers associated with the plurality of barrels;

a swashplate entirely tiltable by a swivel torque to vary a displacement of the plurality of plungers relative to the plurality of barrels;

a port plate configured to engage an end of the rotatable body and having:

an inlet port;

a discharge port; and a protrusion; and an actuator piston and a biasing piston disposed within the housing and configured to selectively engage the protrusion of the port plate to rotate the port plate and adjust the swivel torque, wherein the actuator piston and the biasing piston are entirely hydraulically actuated.

2. The pump of claim 1, wherein the protrusion includes a tab that protrudes radially outward from a periphery of the port plate.

3. The pump of claim 1, wherein the actuator and biasing pistons are arranged to urge the port plate in opposing rotational directions.

4. The pump of claim 3, wherein the actuator piston is oriented to urge the port plate in a rotational direction opposite a rotational direction of the body.

5. The pump of claim 1, wherein the actuator piston has a pressure area larger than a pressure area of the biasing piston.

6. The pump of claim 1, wherein the biasing piston is continuously fluidly communicated with the discharge port.

7. The pump of claim 6, wherein the biasing piston is located at side of the port plate closest to the discharge port.

8. The pump of claim 6, wherein the actuator piston is selectively communicated with the discharge port and a low-pressure source.

9. The pump of claim 8, wherein the low-pressure source is the inlet port.

10. The pump of claim 8, further including a 3-way valve disposed within the housing and configured to regulate fluid communication with the actuator piston.

11. The pump of claim 10, wherein the 3-way valve includes a pilot-operated element moveable in response to a fluid pressure at the discharge port from a first position at which fluid from the discharge port is fluidly communicated with the actuator piston, against a spring bias toward a second position at which the actuator piston is fluidly communicated with the low-pressure source.

12. The pump of claim 10, wherein the 3-way valve includes a solenoid-operated element moveable in response to a pressure signal from a first position at which fluid from the discharge port is fluidly communicated with the actuator piston, against a spring bias toward a second position at which the actuator piston is fluidly communicated with the low-pressure source.

13. A pump, comprising:

a housing;

a body rotatably disposed within the housing and at least partially defining a plurality of barrels;

a plurality of plungers associated with the plurality of barrels;

a swashplate entirely tiltable by a swivel torque to vary a displacement of the plurality of plungers relative to the plurality of barrels;

a port plate configured to engage an end of the body and having:

an inlet port;

a discharge port; and a tab protruding radially outward from a periphery of the port plate;

a biasing piston disposed within the housing at side of the port plate closest to the discharge port and continuously supplied with pressurized fluid from the discharge port to engage the biasing piston to engage a first side of the tab and urge the port plate to rotate in a direction aligned with a rotational direction of the body, wherein the biasing piston is entirely hydraulically actuated;

an actuator piston disposed within the housing, having a pressure area greater than a pressure area of the biasing piston, and being selectively fluidly communicated with fluid from the discharge port or a low-pressure source to engage a second side of the tab opposite the biasing piston and urge the port plate to rotate in a direction against the rotational direction of the body, wherein the actuator piston is entirely hydraulically actuated; and a 3-way valve disposed within the housing and having a pilot-operated element moveable in response to a fluid pressure at the discharge port from a first position at which fluid from the discharge port is fluidly communicated with the actuator piston, against a spring bias toward a second position at which the actuator piston is fluidly communicated with the low-pressure source.

14. A method of controlling a pump, comprising:

rotating a plurality of plungers past an net port in a plate during extending strokes to draw fluid into a plurality of bores;

rotating the plurality of plungers past a discharge port in the plate during retracting strokes to discharge fluid from the plurality of bores at an elevated pressure; and selectively moving at least one of an actuator piston and a biasing piston to engage and rotate the plate, the actuator piston and the biasing piston being entirely hydraulically actuated, wherein a swashplate of the pump is entirely tiltable by a rotation of the plate to change an effective displacement of the plurality of plungers within the plurality of bores.

15. The method of claim 14, wherein selectively moving at least one piston to engage and rotate the plate includes selectively moving the at least one piston to engage a tab protruding radially outward from a periphery of the plate.

16. The method of claim 14, wherein:

moving the biasing piston includes continuously directing pressurized fluid from the discharge port to the biasing piston; and moving the actuator piston includes selectively fluidly communicating the actuator piston with the discharge port or a low-pressure source.

17. The method of claim 16, wherein selectively fluidly communicating the actuator piston with fluid from the discharge port causes the actuator piston to move the plate in a direction opposite a rotational direction of the plurality of plungers.

18. The method of claim 16, wherein, when both the biasing piston and the actuator piston are simultaneously fluidly communicated with the discharge port, the actuator piston creates a greater force on the plate.

* * * * *